US005904059A

United States Patent [19]

Perna

[11] Patent Number: 5,904,059

[45] Date of Patent: May 18, 1999

[54] STRAIGHTENING APPARATUS

[75] Inventor: Antonio Andrew Perna, Peterborough, United Kingdom

[73] Assignee: Pave Automation Design and Development Limited, United Kingdom

[21] Appl. No.: 08/829,589

[22] Filed: Mar. 31, 1997

[30] Foreign Application Priority Data

Oct. 9, 1996 [GB] United Kingdom ..... 9618893

[51] Int. Cl.[6] ..... B21F 01/02

[52] U.S. Cl. ..... 72/79; 140/147

[58] Field of Search ..... 72/79; 140/147

[56] References Cited

U.S. PATENT DOCUMENTS

| | | | |
|---|---|---|---|
| 998,087 | 7/1911 | Greiner | 72/79 |
| 3,264,855 | 8/1966 | Turbett | 72/79 |
| 4,046,177 | 9/1977 | Loais | 140/147 |
| 4,167,239 | 9/1979 | Bihler | 226/150 |
| 4,177,843 | 12/1979 | Sarver | 72/79 |
| 4,920,776 | 5/1990 | Denzler | 72/79 |

FOREIGN PATENT DOCUMENTS

| | | | |
|---|---|---|---|
| 44-2357 | 1/1969 | Japan | 72/79 |
| 719051 | 11/1954 | United Kingdom . | |
| 719873 | 11/1954 | United Kingdom . | |
| 2 229 661 | 10/1990 | United Kingdom | 72/79 |
| 2 290 247 | 12/1995 | United Kingdom . | |

*Primary Examiner*—Lowell A. Larson
*Attorney, Agent, or Firm*—Lee, Mann, Smith, McWilliams, Sweeney & Ohlson

[57] ABSTRACT

Apparatus for straightening elongate material, such as wire, has a rotary member which includes an internal passage through which the material is passed. Guide means in the rotary member guide the material through the passage and include deflection means for deflecting, and thus flexing, the material as it passes through the rotary member. The deflection means is so shaped as to cause the path taken by the material to have a first, curved portion which is directed away from the axis followed by a second portion, which is substantially parallel with the axis of rotation or is less tightly curved as the first portion, both portions being spaced from said axis of rotation, and preferably preceding a third curved portion which is substantially the same radius of curvature as the first curved portion and which directs the wire back towards said axis of rotation. This arrangement allows for a greater degree of flexing of the wire for any given extent of radial displacement from the axis of rotation and thus improves the effectiveness of the straightening apparatus. The straightening apparatus can be used in a wire bending machine which incorporates a bending head situated downstream of the straightening apparatus.

24 Claims, 8 Drawing Sheets

STRAIGHTENING APPARATUS

FIELD OF THE INVENTION

This invention relates to apparatus for straightening elongate material, such as wire or tubing, and is particularly concerned with wire straightening apparatus. The invention also relates to a wire bending machine which includes such wire straightening apparatus.

BACKGROUND TO THE INVENTION

Wire straightening apparatus is used to straighten wire, supplied in a rolled or coiled stock, before the wire is bent into a desired shape by the bending head of a bending machine The removal of the twist enables the bending head to bend the wire in a predetermined plane, and thus allows the shape of the final bent wire product to be controlled.

One example of wire straightening apparatus is discussed in UK Patent No. 2185921 (Benton), and comprises a pair of counter rotating spinners, each having a respective set of rollers between which the wire is fed. The rollers deflect the wire, as it travels through the spinners, and this deflection straightens the wire.

However, wire fed through such apparatus can still have some residual twist, which can result in the creation of a deformed product. In addition, the amount of deflection undergone by the wire as it passes through the spinners can be such that the straightening apparatus causes wearing or work hardening of the wire.

SUMMARY OF THE INVENTION

According to a first aspect of the invention, there is provided apparatus for straightening elongated material, the apparatus comprising a rotary member having a passage through which the material passes and guide means for guiding the material through the passage in the rotary member, the guide means including deflection means for deflecting the material away from the axis of rotation of the rotary member, wherein the deflection means is so shaped as to cause the path taken by the material to have a first, curved, portion which is directed away from said axis, followed by a second portion, which is substantially parallel with the axis of rotation or is less tightly curved than the first portion, both portions being disposed on the same side, relative to the rotary member, of said axis of rotation, the arrangement being such that the rotation of the rotary member about its axis straightens material fed therethrough.

The second portion of the path enables the first portion to have a smaller radius of curvature, for a given radial displacement of the wire, than would be possible if the wire followed a simple curved path away from the axis of rotation. Thus, the material can be deflected through a relatively tight curve, whilst remaining relatively close to the axis of rotation. It is believed that this combination of a relatively small radius of curvature and a small displacement from the axis gives rise to the improved performance compared with known types of wire straightening apparatus.

Preferably, the apparatus is arranged to straighten wire.

Preferably, the deflection means is also so shaped that the path taken by the wire has a third portion, downstream of the second portion, which is curved, and along which the wire travels towards the axis of rotation of the rotary member.

Preferably, the first and third portions have substantially the same radius of curvature as each other.

Preferably, the deflection means comprises a sleeve through which the wire passes, the sleeve being so shaped that the first and third portions of the path are situated at the regions of the entrance and exit of the sleeve respectively, the sleeve, in use, being radially spaced from, and substantially parallel to, the axis of rotation of the rotary member.

Preferably, the inner surface of the sleeve has a substantially cylindrical portion which extends in a direction substantially parallel to the axis of rotation of the rotary member, for guiding the wire along said second portion of the path.

Such a sleeve is particularly suitable for use as deflection means, since it allows the wire to curve at its entrance and exit, whilst preventing any substantial curving of the wire travelling through the sleeve. The sleeve also enables the first, second and third portions of the path to be positioned close together.

Preferably, the inner surface of the sleeve is, in profile, curved away from the sleeve axis at its entrance and exit.

The curved parts of the sleeve assist in the forming of the curved portions of the wire path.

Preferably, the sleeve is rotatable about its axis relative to the rotary member, and to that end is preferably mounted on the rotary member via low friction rolling elements, for example ball bearings.

A sleeve which is rotatable relative to the rotary member is less prone to wear than a non rotatable sleeve, since the sleeve can remain angularly fixed relative to the wire passing therethrough. As well as reducing the wear on the sleeve, this feature also reduces the amount of torsional force which the sleeve exerts on the wire.

Preferably, the deflection means is one of a plurality of such deflection means and adjacent deflection means are, in use, radially and axially spaced from each other so as to deflect the wire in opposite radial directions relative to the axis of rotation of the rotary member.

Preferably, adjacent deflection means are, in use, arranged to deflect the wire to opposite sides of said axis of rotation, relative to the rotary member.

Preferably, the rotary member includes a respective axial guide at its entrance and exit, the axial guides causing the path of the wire to be substantially co-axial with the axis of rotation of the rotary member.

Preferably, the rotary member is one of a pair of such members, and the apparatus includes drive means for causing the rotary members to counterotate.

Preferably, the apparatus includes feed means for feeding wire through the rotary members at a variable rate and control means connected to the feed means and drive means, the control means being operable to cause the rotational speed of the rotary members to increase and decrease in response to corresponding variations in the rate at which wire is fed through the members.

Preferably, the control means is so arranged that there is substantially no rotation of the rotary members while the wire is stationary relative to those members.

Thus, if the apparatus is installed in a wire bending machine, the control means prevents the rotary members from damaging the wire (for example by work hardening) while wire downstream of the rotary members is being bent, a process during which the wire, at times, is held stationary relative to the bending head.

Preferably, the control means is so arranged that the speed of rotation of the rotary members is proportional to the rate at which wire is fed through them, the ratio of the rotational speed to feed rate thus being substantially constant (for non-zero rates of wire feed).

Preferably, the control means is operable to cause the drive means to rotate the rotary members by between one half and six (preferably five) revolutions for every inch (2.54 cm) of wire fed therethrough. Thus if, for example, the wire is being fed through the rotary members at a rate of 1 meter per second, the control means will cause the rotary members to rotate at around 2,360 rpm if the members are to rotate once for every inch of wire fed therethrough, around 11,800 rpm in order to achieve five revolutions per inch of wire, or around 14,160 rpm if a rate of six revolutions per inch is required.

Preferably, the or each rotary member comprises a hollow elongate housing which accommodates a plurality of deflection members, and retaining means for retaining the deflection members in the housing at axially spaced positions therealong.

Such an arrangement of deflection members and housing can be configured to have a relatively low moment of inertia. This in turn facilitates the angular acceleration and deceleration of the rotary member and reduces wear and tear on the member and on the means for rotating it.

Preferably, the deflection members are axially spaced from each other within the housing.

The resultant gaps between the deflection members allow dirt or debris generated at the deflection members to move clear of the latter.

Preferably, the deflection members are removably retained in the housing. This feature facilitates the maintenance of the rotary member, since a deflection member can be removed for servicing or be replaced with a new deflection member when worn.

To that end, the housing preferably includes a plurality of axially spaced radial apertures through which the deflection members can be inserted or removed.

Preferably, the retaining means comprises bar means releasably attachable to the exterior of the housing so as to extend across the apertures, and the deflection members are so shaped that they matingly engage the bar means so as to be angularly located relative to the housing.

Preferably, each aperture is one of a respective pair of opposed apertures in the housing, and the retaining means preferably includes adjustment means for adjusting the radial positions of the deflection members.

This provides some control over the extent by which the wire is radially deflected as it passes through the rotary member.

Preferably, the adjustment means comprises a plurality of screw threaded shafts each of which extends through a respective screw threaded aperture in the bar means to engage a respective deflection member.

Preferably, each deflection member comprises a sub assembly having a body in which a sleeve is mounted, the arrangement being such that, in use, the wire passes through and is engaged by the sleeve, thereby causing said deflection.

The sleeve is preferably mounted on a body through a deep groove ball bearing.

Preferably, the sleeve is releasably retained on the body by, for example, circlips.

The ends of the body which are accessible through the pair of apertures preferably include a slot for engaging the bar means.

Preferably, the sleeve is not equidistant between the inboard ends of the slots.

This facilitates the setting up of the rotary member so that the wire is deflected relative to the axis of rotation. Moreover, the deflecting of the wire to alternating sides of the housing axis can be facilitated by having adjacent deflection members angularly displaced by 180° relative to each other.

The invention also lies in a wire bending machine comprising a bending head, feed means for feeding wire from a coiled or rolled stock to the bending head, and wire straightening apparatus in accordance with the first aspect of the invention situated upstream of said bending head.

BRIEF DESCRIPTION OF THE DRAWINGS

Two embodiments of wire straightening apparatus, in accordance with the invention, will now be described, by way of example only, with reference to the accompanying drawings in which.

DETAILED DESCRIPTION

Figure 1:
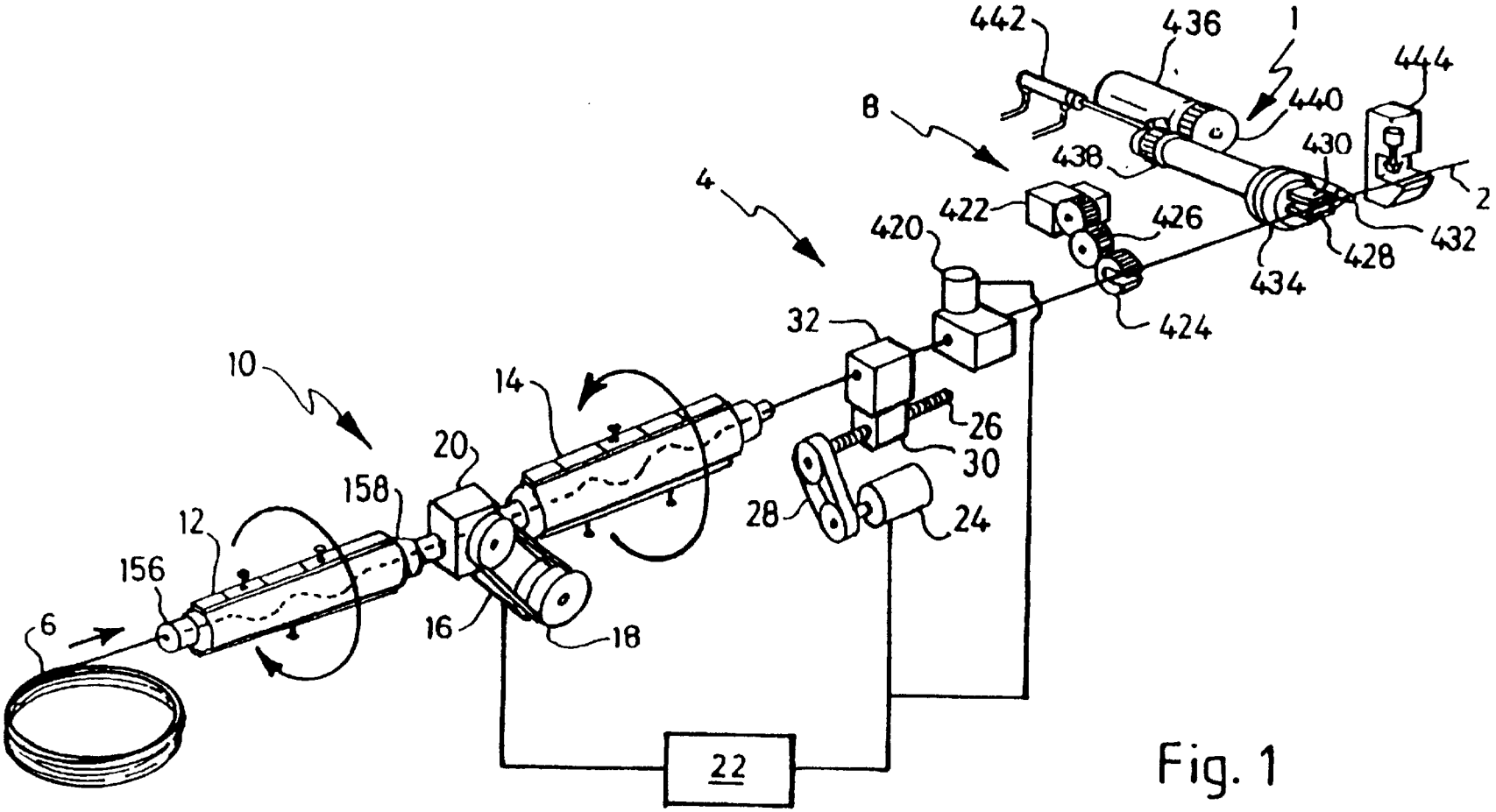
FIG. 1 is a diagrammatic isometric view of a wire bending machine fitted with wire straightening apparatus in accordance with the invention.

FIG. 1 shows a bending machine having a bending head 1 to which a wire 2 is fed by a feed mechanism 4 from a coiled stock 6. The machine includes a rotatable gripper mechanism 8 for rotating the wire 2 about its own axis, and wire straightening apparatus 10 which is interposed between the feed mechanism 4 and the stock 6.

The straightening apparatus 10 comprises a pair of co-axial cylindrical rotary members, referred to as spinners, 12 and 14 which are arranged in series and connected to a motor 16 through a pulley and belt transmission 18 and a gear box 20.

The motor 16 is operable to rotate the spinners 12 and 14 respectively in a clockwise and an anticlockwise direction as viewed in FIG. 1 at an angular speed which is controlled by a control unit 22.

The spinners 12 and 14 are identical, and only the components of the spinner 12 will be described in detail.

Figure 2:
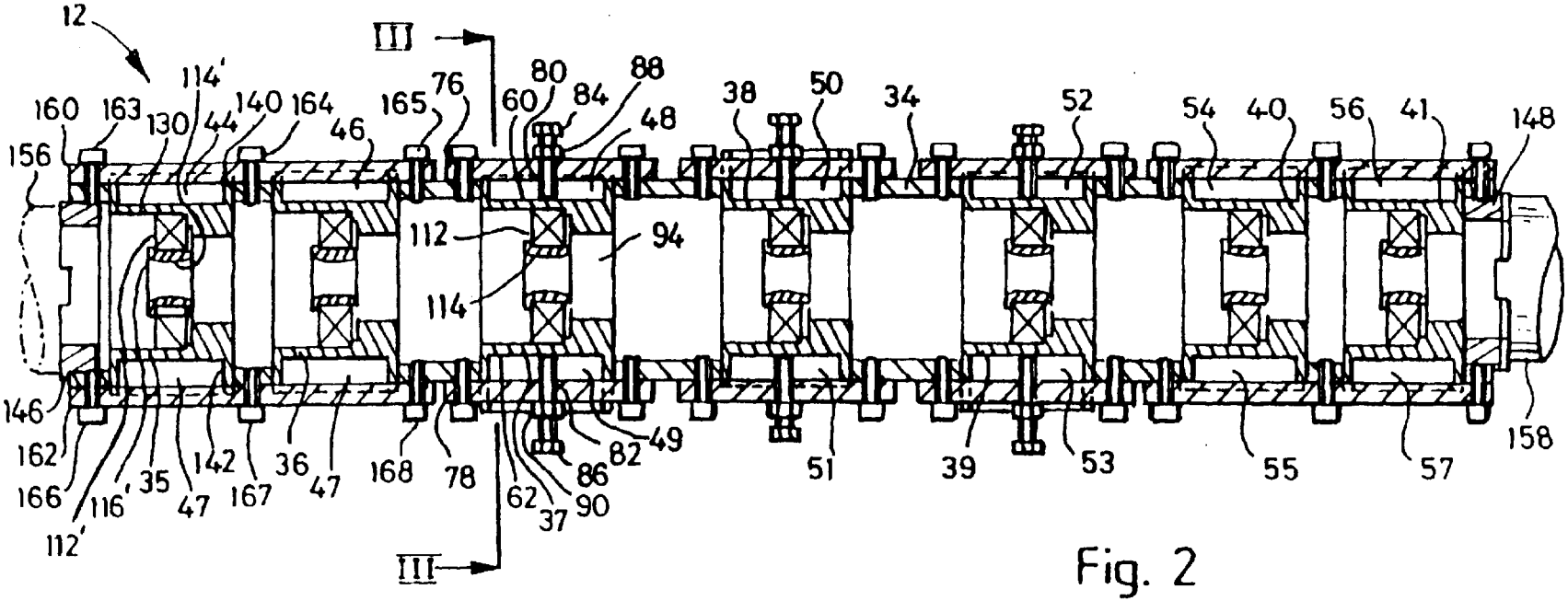
FIG. 2 is a sectional side view of a rotary member of one embodiment of the wire straightening apparatus.
Figure 3:
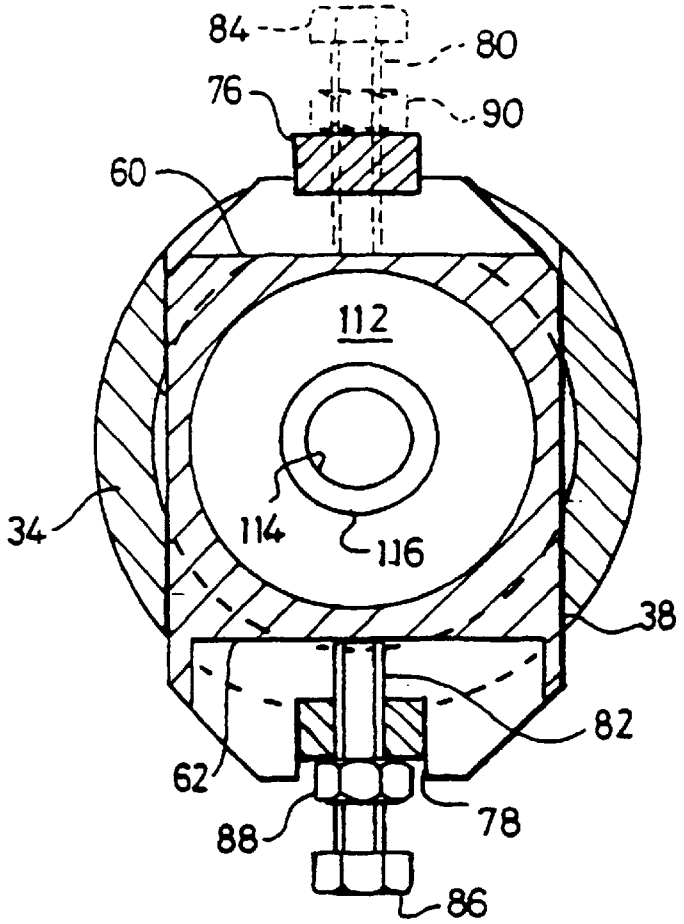
FIG. 3 is a cross-sectional view taken along the line III—III of FIG. 2.

Referring to FIG. 2, the spinner 12 comprises a hollow cylindrical housing 34 which contains seven axially-spaced cylindrical bodies 35–41.

Figure 6:
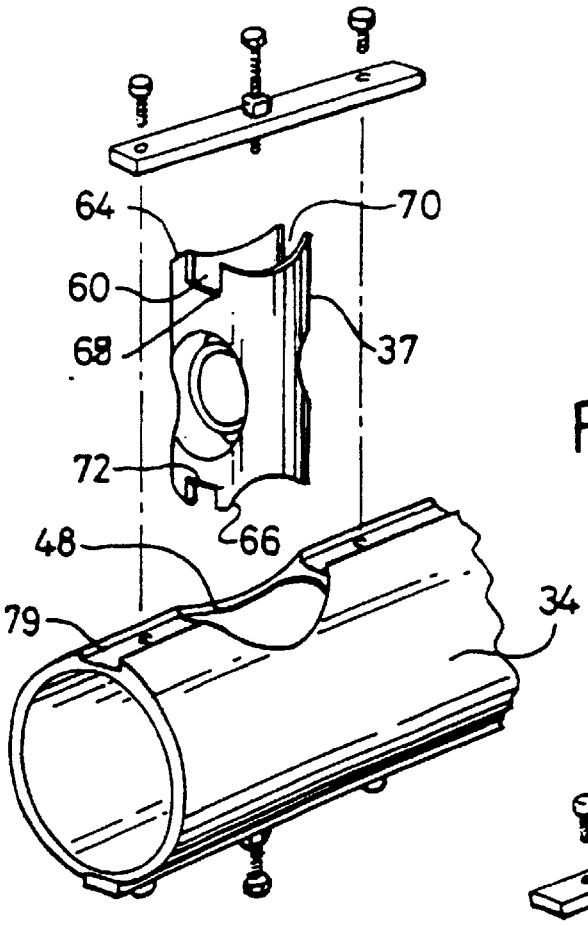
FIG. 6 is a partially exploded perspective view of a region of the rotary member between its two ends.

The axis or each cylindrical body is substantially perpendicular to the elongate axis of the housing 34, and the ends of each housing extend into a respective pair of diametrically opposed circular apertures in the housing 34. Those apertures are indicated by the reference numerals 44–57 (apertures 48 and 44 being more clearly shown in FIGS. 6 and 7 respectively), and are of a slightly larger diameter than that of the cylindrical bodies 35–41 so that the bodies 35–41 can be inserted into and removed from the housing 34 through the apertures, and the ends of the bodies are accessible through the apertures when the bodies are in position in the housing 34.

The bodies 37–39 are identical with each other, and only the body 37 will therefore be described in detail.

With reference to FIGS. 3–6, the body 37 is formed with two flat end faces 60 and 62, each of which is surrounded by a respective one of two cylindrical peripheral walls 64 and 66 which are formed as extensions to the sides of the body 37. The walls 64 and 66 have part circular portions formed at their outboard ends, and each of the walls includes a pair of opposed slots. The slots in the wall 64 are denoted by the reference numerals 68 and 70, whilst reference numerals 72 and 74 denote the slots in the wall 66.

Figure 4:
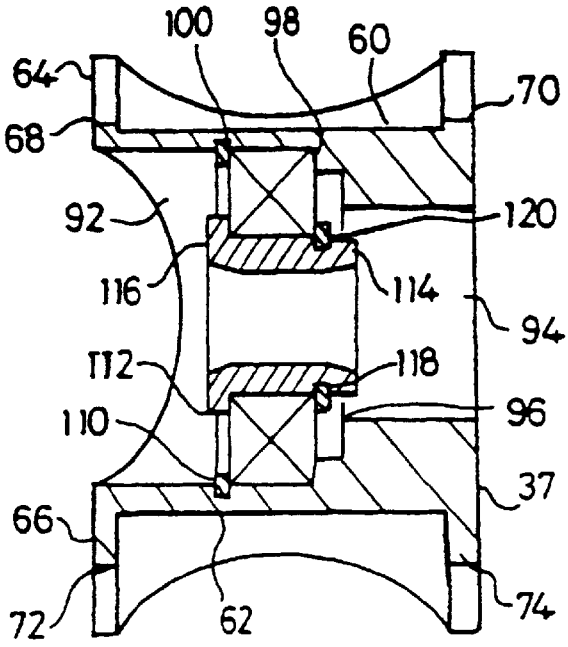
FIG. 4 is a sectional side view of one of a number of deflection members forming part of the rotary member.

As can be seen from the drawings, particularly FIG. 4, the face 60 is closer to the inboard ends of the slots 68 and 70 than is the face 62 to the inboard ends of the slots 72 and 74.

With the body 37 in place in the housing 34, the slots 68 and 70 matingly engage a bar 76 which extends, in the direction of the axis of the housing 34, across the aperture 48, and which is screwed at either end to the housing 34. The slots 72 and 74 matingly engage a similar bar 78 which extends across the aperture 49. The engagement of the slots with the bars 76 and 78 provides angular location of the body 37 in the housing 34, and also prevents the body 37 from dropping out of the housing 34 through either of the apertures 48 and 49.

The bars are partially accommodated in two opposed recesses 79 and 81 (FIG. 7) running along the length of the housing 34.

The bars 76 and 78 include central screw-threaded bores through which two screw-threaded adjustment shafts, respectively referenced 80 and 82, extend. The ends of the shafts 80 and 82 external to the housing 34 are terminated in heads 84 and 86 for facilitating the rotating of the shafts so as to vary the distance by which they extend radially into the housing 34.

The opposite ends of each shaft engages a respective one of the faces 60 and 62, so that the shafts provide radial location for the body 37 relative to the housing 34. The external portions of the shafts also carry locking nuts 88 and 90 which define (adjustable) limits of movement of the shafts into the body 34.

With reference to FIG. 4, the body 37 has a central passage 92 which includes a reduced diameter exit 94, and which is stepped so as to define two annular shoulders 96 and 98. The shoulders 96 and 98 are situated between the exit 94 and an annular groove 100 which accommodates a removable circlip 110.

The circlip 110 helps to hold a deep-groove ball bearing 112 against the shoulder 98. The deep-groove ball bearing 112 provides rotatable mounting for a cylindrical sleeve 114 which extends through the bearing 112, and which includes a radial outer flange 116 at one end, and an annular groove 118 in the region of its other end.

The flange 116 is of a larger diameter than the inner periphery of the bearing 112, whilst the annular groove 118 accommodates a circlip 120 which is also of a larger diameter than the inner periphery of the bearing 112. Thus, the sleeve 114 is retained in position in the bearing 112 by the engagement of the flange 116 and circlip 120 with the bearing 112.

Figure 5:
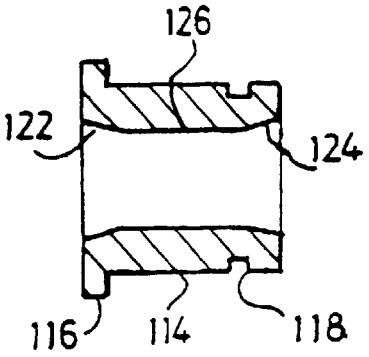
FIG. 5 is a more detailed sectional side view of one of the components shown in FIG. 4.

The sleeve 140 is shown to an enlarged scale in FIG. 5, from which it can be seen that the inner surface of the sleeve has two curved end portions 122 and 124 disposed one on either side of a central, untapered cylindrical portion 126.

The components shown in FIG. 4 can all be inserted into or removed from the housing 34 as a single sub-assembly. The bodies 38 and 39 contain identical bearings, sleeves and circlips, those components forming identical sub-assemblies to that shown in FIG. 4, and are retained in position by identical arrangements of bars, screws and adjustment shafts, to those used for the body 37.

Figure 7:
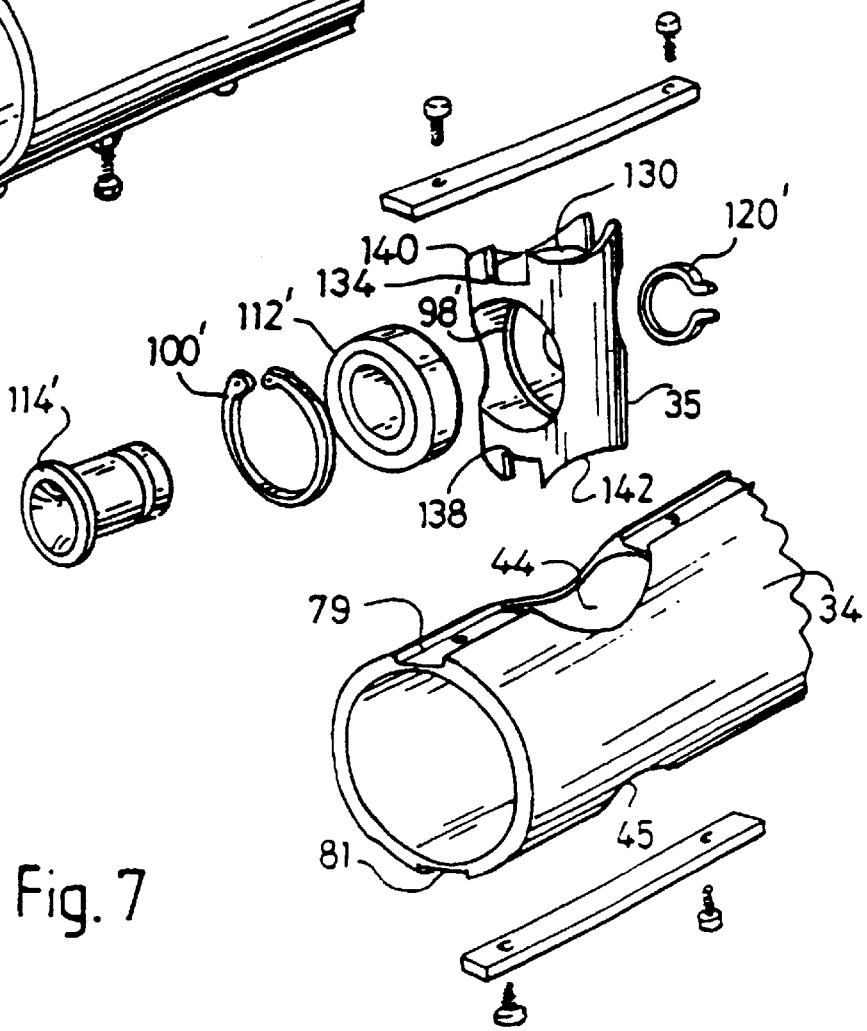
FIG. 7 is an exploded sectional view of an end region of the rotary member.

The body 35 is shown in more detail in FIG. 7, and forms part of another sub-assembly which is identical to the sub-assembly shown in FIG. 4 in all features other than the shape of the body. In this case, the body 35 is, in the section shown in FIG. 2, symmetrical about the axis of the housing 34. Thus, the body has two end faces 130 and 132 which are spaced by the same distance from the inboard end (for example 134 and 138) of the slots in the peripheral walls 140 and 142 which surround the faces 130 and 134. Since the components housed within the body 35 are identical to those in the body 37, they have been indicated in FIG. 7 by identical reference numbers followed by the symbol '.

Figure 16:
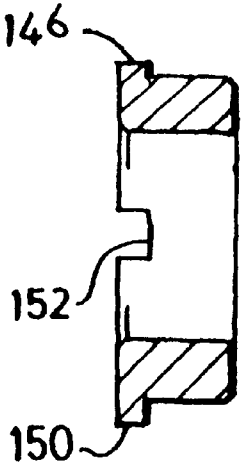
FIG. 16 is a sectional side view of that end fitting.
Figure 15:
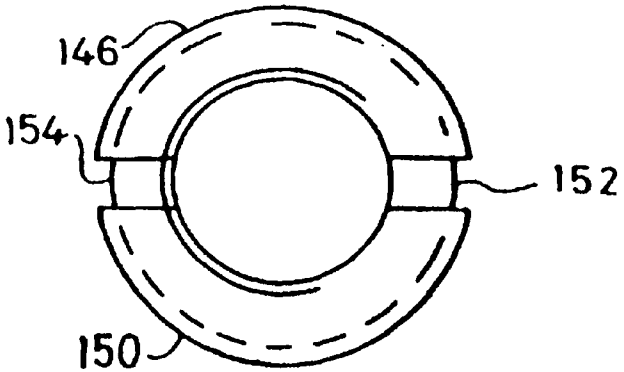
FIG. 15 is an end view of one of two end fittings for the housing (of either embodiment)

The spinner 12 also includes identical end pieces 146 and 148. The end piece 146 is shown in more detail in FIGS. 15 and 16, and takes the form of a cylinder which includes a radial outer end flange 150 and two diametrically opposed slots 152 and 154 which provide rotational key to a complementary cylindrical inlet guide 156.

(FIG. 1). The corresponding slots in the end piece 148 provide a rotational key to a complementary cylindrical connector 158 which connects the member 12 to the output of the gearbox 20.

Each of the bodies 36, 40 and 41 is identical to the body 35 and contain identical components to those contained in that body.

Bodies 35 and 36 are held in position by two bars 160 and 162 which engage in the slots in the ends of the bodies 35 and 36. The bar 160 extends across the apertures 44 and 46, whilst the bar 162 extends across the apertures 45 and 47. Both bars are screwed to the body 34 by the fixing screws 163–168 as shown in FIG. 2. A similar arrangement of bars and fixing screws retains the bodies 40 and 41 in position. When so retained, the bodies 35, 36, 40 and 41 are so positioned that their central passages, and hence the sleeves therein, are co-axial with the axis of the body 34.

The body 38 is inverted relative to the bodies 37 and 39 so that the end face of the body 38 which is closer to the inboard end of its corresponding slot is downwardly facing when the bodies are orientated as shown in FIG. 2. With the rotary member set up as shown in FIG. 2, the screw-threaded adjustment shafts have been so positioned that the sleeves within the bodies 37–39 are co-axial with the axis of the housing 34. When in this position, the body 38 is at the top of its range of allowable motion (when orientated as shown in FIG. 2) whilst the bodies 37 and 39 are at the bottom of theirs.

When the bodies are so positioned, the wire 2 may be readily "threaded" through the rotary member (the tapered entrances to the sleeves facilitate the threading process). Once the wire 2 has been threaded through the rotary member, the adjustment shafts for the members 37–40 are altered until the members are in positions such as are shown in FIG. 8, in which the sleeves in the members 37 and 40 are radially displaced in one direction relative to the axis of the housing 34, whilst the sleeve in the body 38 is radially displaced in the opposite direction.

On its passage through the spinner 12, the wire 2 is deflected by the sleeve in the rotary member 37 along a path which has an initial curved portion 170 followed by a second portion 172 which is substantially parallel with the axis (denoted by 174) of the housing 34 before the wire reaches a third curved portion 176. Each of the sleeves in the bodies 38 and 39 deflects the wire along a path which has a respective set of three similar portions. The co-axial sleeves in the pairs of bodies 35, 36 and 40, 41 cause the path of the wire 2 to be coaxial (with the spinner axis) respectively before and after the radial displacement by the sleeves shown in FIG. 8 occurs.

Figure 8:
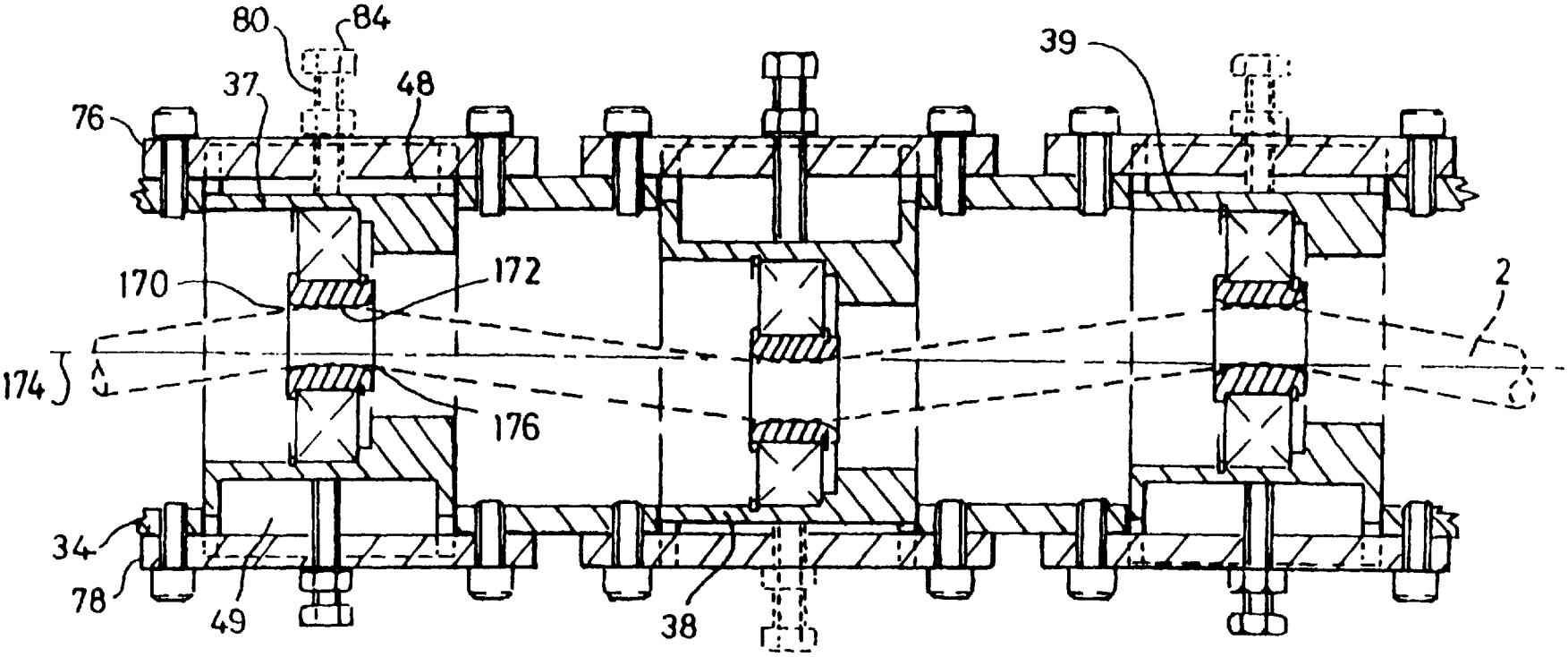
FIG. 8 is a sectional side view of part of the rotary member, showing wire passing therethrough.

Since the spinner 12 rotates as the wire is fed therethrough, the radial displacement caused by the sleeves shown in FIG. 8 results in the wire travelling along a generally helical path.

Figure 9:
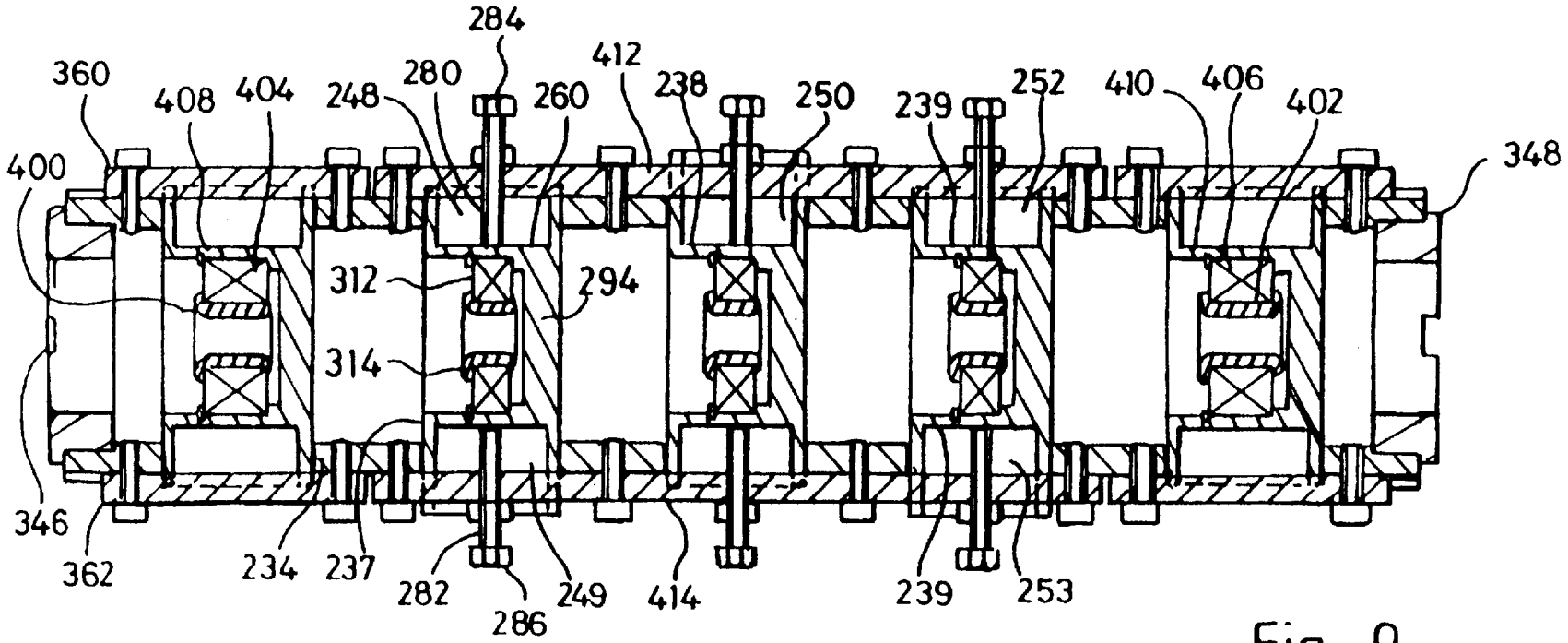
FIG. 9 is a sectional side view, corresponding to FIG. 2, of the rotary member of the second embodiment of wire straightening apparatus.
Figure 11:
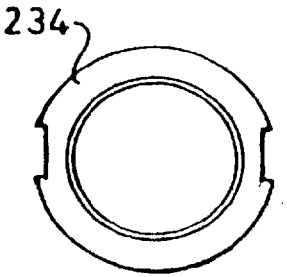
FIG. 11 is an end view of the housing.

FIG. 9 shows a spinner of an alternative embodiment of wire straightening apparatus. That spinner is identical to the spinner 12 (and hence the spinner 14) in all respects apart from the arrangement of sleeves at the entrance and exit of the spinner (and apertures in the body for accommodating the associated cylindrical bodies) and the means of retaining the cylindrical bodies within the housing. Accordingly, features corresponding to those of the spinner 12 are indicated by the same reference numerals raised by 200.

Figure 14:
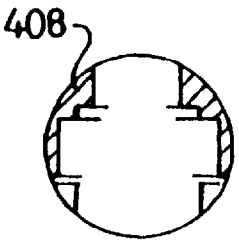
FIG. 14 is a sectional view along the line XIV—XIV of FIG. 12.
Figure 13:
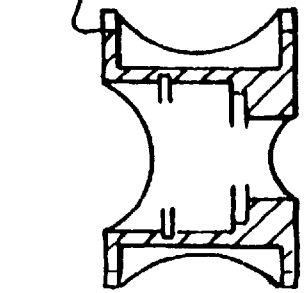
FIG. 13 is a sectional side view of that component.
Figure 12:
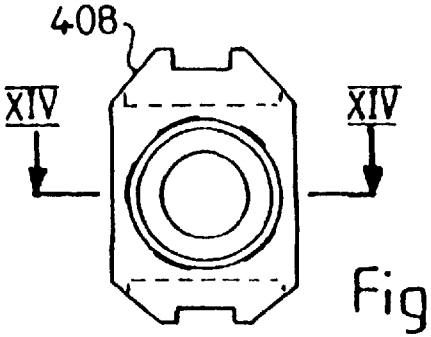
FIG. 12 is a front view of one of the components housed in the housing.

Instead of having four axial end sleeves contained in corresponding bodies (35, 36,40 and 41) the spinner of the second embodiment has two axial end sleeves 400 and 402 of extended length. Those sleeves are mounted by deep-groove ball bearings 404 and 406 in cylindrical bodies 408 and 410 of enlarged diameter compared with the bodies 237–239. Apart from their dimensions, the bodies 408 and 410 and bearings 404 and 406 are identical to the other bodies and bearings of the spinner. The shape of the body 408 (and hence the body 410) is indicated in greater detail in FIGS. 12–14. The body 234 has correspondingly enlarged apertures 409 and 411 for accommodating the ends of the bodies 408 and 410.

Figure 10:
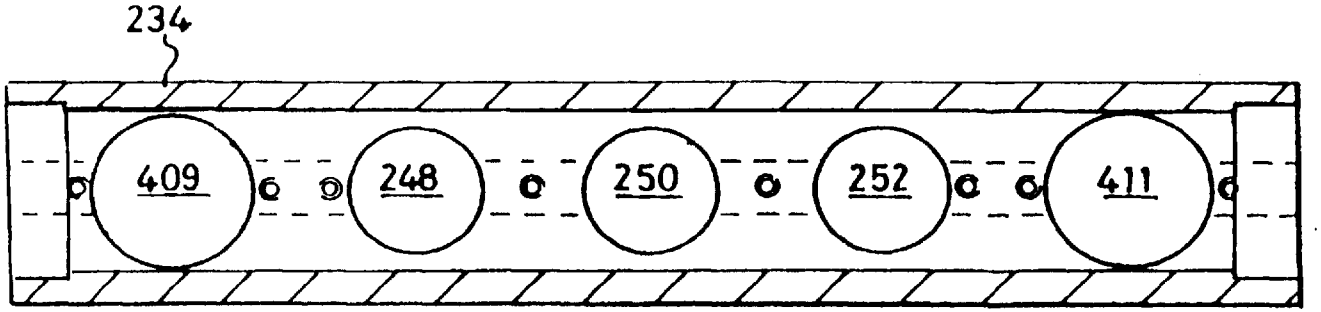
FIG. 10 is a longitudinal sectional view of a housing forming part of that rotary member.
Figure 17:
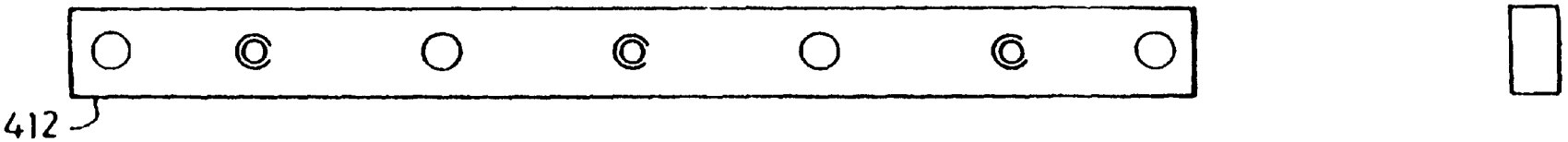
FIG. 17 is a plan view of another component of the rotary member of the second embodiment.

Each of the other bodies of the second embodiment, unlike those of the first embodiment, is not held in place by a respective pair of bars. Instead, all three bodies 237, 238 and 239 are retained and angularly located in the housing 234 by a single pair of opposed common bars 412 and 414. Each bar is held in position by a respective set of four screws which extend into screw-threaded holes (some of which are visible in FIG. 10) in the body 234. The bar 412 is shown in more detail in FIG. 17, from which it will be seen that the bar includes four large diameter apertures for accepting the screws for fixing to the body 234 and three smaller dimension apertures, arranged in alternating relationship with the large diameter apertures which accommodate the screw-threaded radial adjustment shafts for the bodies 237–239.

Referring back to FIG. 1, the control unit 22 is connected to, and controls the speed of operation of a motor 24 on the feed mechanism 4. The motor 24 is, in turn, connected to a screw-threaded shaft 26 through a belt and pulley transmission 28.

The shaft 26 extends through a screw-threaded passage in a block 30. The screw-threads on the shaft 26 and in the passage complement each other so that rotation of the shaft 26 moves the block 30 therealong. The block 30, in turn, carries a pneumatic clamp 32 through which the wire 2 extends.

The control unit 22 also controls the operation of a fixed pneumatic clamp 420 which forms part of the feed means 4 and is situated downstream of the reciprocating clamp 32.

The clamp 420 holds the wire 2 during the return strokes of the reciprocating clamp 32, but is released from the wire 2 when the latter is being held by the clamp 32 during its advance strokes (which feed the wire 2 through the apparatus).

The control unit 22 so controls the speed of operation of the motors 16 and 24 that each of the spinners 12 and 14 undergoes one complete revolution for each inch of wire 2 drawn therethrough. Thus, if the wire 2 is drawn through the spinners 12 and 14 at a speed of 1 meter per second during advance strokes of the clamp 32, the rotary members 12 and 14 are rotated at a speed of 2,362 rpm. However, at the end of the advance stroke of the clamp 32, and during its subsequent return stroke, there is no feed of the wire 2 through the spinners 12 and 14. During this time, therefore, there is correspondingly no rotation of the spinners 12 and 14.

The clamps 32 and 420 can be operated to feed the wire through the machine in a reverse direction, which enables certain shapes of wire to be formed by the head 1. However, it is undesirable to feed the wire through the spinners 12 and 14 in a reverse direction, and to avoid this the wire straightening apparatus 10 is mounted on a carriage (not shown) for moving the apparatus in a reverse direction during such reverse feed of the wire.

The wire twisting apparatus 8 comprises a motor 422 connected to a releasable clamp 424 via an intermediate gear wheel 426. When the wire 2 is not being fed through the machine (in either direction) the clamp 424 is operable to grip the wire 2 and the motor 422 to rotate the clamp 424 to twist the wire 2 about its own axis to enable the bending head 1 to form wire products which are bent in more than one plane.

The bending head 1 is similar to the bending head used on the CNC-8 Omni-Forming Centre produced by Pave Automation Design and Development Limited, and comprises a pair of opposed guide projections 428 and 430 through which the wire 2 passes, and a finger 432 mounted on a rotatable support 434. The support 434 is, in turn, connected to a motor 436 through gear wheels 438 and 440, and is, in use, rotated by the motor 436, thus causing the finger 432 to bend the wire 2 against either of the projections 430 and 428. The bending head 1 is connected to pneumatic cylinder 442 which is operable to move the bending head in a direction perpendicular to the wire axis. This enables the finger 432 to be moved clear of the wire 2 so that subsequent rotation of the support 434 can move the finger 432 to either side of the wire 2. Wire products which have been bent at the bending head 1 are subsequently severed from the rest of the wire by a guillotine 444 situated downstream of the head 1.

In a modified version of the machine, the guillotine 444 is situated just upstream of the bending head 1 (i.e. between the head 1 and gripper mechanism 8).

I claim:

1. Apparatus for straightening elongate material, the apparatus comprising a pair of rotary members arranged in series and drive means for counter-rotating the rotary members, each rotary member having a passage through which the material passes and guide means for guiding the material through the passage in the rotary member, the guide means including deflection means for deflecting the material away from the axis of rotation of the rotary member, wherein the deflection means is so shaped as to cause the path taken by the material to have a first, curved portion which is directed away from said axis, followed by a second portion, which is substantially parallel with the axis of rotation or is less tightly curved than the first portion, both portions being spaced from said axis of rotation, the deflection means comprising a sleeve positioned in the path of wire through the rotary member, the sleeve being rotatably mounted on the member so as to be rotatable relative to the member about an axis substantially parallel with the axis of rotation of the member, the apparatus further comprising feed means for feeding material through the rotary members at a variable rate and control means operable to control the drive means to cause the speed of rotation of the rotary members to be proportional to the rate at which wire is fed through them and wherein the feed means comprises a reciprocating clamp moveable through a succession of alternating advances and return strokes, and operable to grip the material during the advance strokes and to release the material during the return strokes.

2. Apparatus according to claim 1, in which the apparatus is arranged to straighten wire.

3. Apparatus according to claim 1, in which the deflection means is also so shaped that the path taken by the material has a third portion, downstream of the second portion, which is curved, and along which the material travels back towards the axis of rotation of the rotary member.

4. Apparatus according to claim 1, in which the deflection means is so arranged that the first and third portions have substantially the same radius of curvature as each other.

5. Apparatus according to claim 4, in which the sleeve is so shaped that the first and third portions of the path are situated at the regions of the entrance and exit of the sleeve respectively, the sleeve, in use, being radially spaced from, and substantially parallel to, the axis of rotation of the rotary member.

6. Apparatus according to claim 5, in which the inner surface of the sleeve has a substantially cylindrical portion which extends in a direction substantially parallel to the axis of rotation of the rotary member, for guiding the wire along said second portion of the path.

7. Apparatus according to claim 5, in which the inner surface of the sleeve is, in profile, curved away from the sleeve axis at its entrance and exit.

8. Apparatus according to claim 1, in which the deflection means is one of a plurality of such deflection means and adjacent deflection means are, in use, radially and axially spaced from each other so as to deflect the wire in opposite radial directions relative to the axis of rotation of the rotary member.

9. Apparatus according to claim 8, in which adjacent deflection means are, in use, arranged to deflect the wire to opposite sides of said axis of rotation, relative to the rotary member.

10. Apparatus according to claim 1, in which the rotary member includes a respective axial guide at its entrance and exit, the axial guides causing the path of the wire to be substantially co-axial with the axis of rotation of the rotary member.

11. Apparatus according the claim 1, in which the control means is operable to cause the drive means to rotate the rotary member by between one half and six revolutions for every inch of wire fed therethrough.

12. Apparatus according to claim 11, in which the control means is operable to cause the drive means to rotate the rotary member by 5 revolutions for every inch of wire fed therethrough.

13. Apparatus according to claim 1, in which the rotary member comprises a hollow elongate housing which accommodates a plurality of deflection members, and retaining means for retaining the deflection members in the housing at axially spaced positions therealong.

14. Apparatus according to claim 13, in which the deflection members are axially spaced from each other within the housing.

15. Apparatus according to claim 13, in which the deflection members are removably retained in the housing.

16. Apparatus according to claim 15, in which the housing includes a plurality of axially spaced radial apertures through which the deflection members can be inserted or removed.

17. Apparatus according to claim 16, in which the retaining means comprises bar means releasably attachable to the exterior of the housing so as to extend across the apertures.

18. Apparatus according to claim 17, in which each aperture is one of a respective pair of opposed apertures in the housing.

19. Apparatus according to claim 18, in which the ends of the body which are accessible through the pair of apertures include a slot for engaging the bar means.

20. Apparatus according to claim 19, in which the sleeve is not equidistant between the inboard ends of the slots.

21. Apparatus according to claim 1, in which each deflection means comprises a sub assembly having a body in which the sleeve is mounted.

22. Apparatus according to claim 21, in which the sleeve is mounted on a body through a deep groove ball bearing.

23. Apparatus according to claim 21, in which the sleeve is releasably retained on the body by circlips.

24. A wire bending machine comprising a bending head, feed means for feeding wire from a coiled or rolled stock to the bending head, and wire straightening apparatus in accordance with claim 1 situated upstream of said bending head.

* * * * *